US005077967A

United States Patent [19]

Widener et al.

[11] Patent Number: 5,077,967

[45] Date of Patent: Jan. 7, 1992

[54] PROFILE MATCHED DIFFUSER

[75] Inventors: Stanley K. Widener, San Antonio, Tex.; Willard J. Dodds, West Chester; Jack R. Taylor, Cincinnati, both of Ohio

[73] Assignee: General Electric Company, Cincinnati, Ohio

[21] Appl. No.: 610,912

[22] Filed: Nov. 9, 1990

[51] Int. Cl.[5] ..... F02C 3/00

[52] U.S. Cl. ..... 60/39.02; 60/751; 415/208.1; 415/211.2

[58] Field of Search ..... 60/39.02, 751; 415/208.1, 208.2, 210.1, 211.2

[56] References Cited

U.S. PATENT DOCUMENTS

| | | | |
|---|---|---|---|
| 2,556,161 | 6/1951 | Bailey et al. . | |
| 3,631,674 | 1/1972 | Taylor . | |
| 3,750,397 | 8/1973 | Cohen et al. | 60/751 |
| 3,877,221 | 4/1975 | Lefebvre et al. | 60/751 |
| 3,879,939 | 4/1975 | Markowski . | |
| 3,978,664 | 9/1976 | Parker et al. . | |
| 4,098,074 | 7/1978 | Greenberg et al. . | |
| 4,194,359 | 3/1980 | Brookman et al. . | |
| 4,380,895 | 4/1983 | Adkins . | |
| 4,527,386 | 7/1985 | Markowski . | |
| 4,549,847 | 10/1985 | Stroem et al. . | |
| 4,573,868 | 3/1986 | Stroem et al. . | |
| 4,677,828 | 7/1987 | Matthews et al. . | |

OTHER PUBLICATIONS

D. L. Burrus et al, Energy Efficient Engine, Combustion System Componet Technology Development Report, NASA Report R82AEB401, Nov 1982, PP., Cover and Title pp., 1-9, 17-20, and 95-132.

*Primary Examiner*—Edward K. Look
*Assistant Examiner*—Christopher M. Verdier
*Attorney, Agent, or Firm*—Jerome C. Squillaro

[57] ABSTRACT

A method of diffusing airflow includes diffusing first and second airflow portions at first and second diffusion rates, respectively, which are unequal for improving pressure recovery. An exemplary diffuser for practicing the invention includes first and second channels separated by a splitter for separately diffusing first and second airflow portions, respectively. The first and second channels have first and second area ratios, respectively, which are unequal for obtaining increased pressure recovery. In the preferred embodiment, the first and second area ratios are preselected for obtaining substantially symmetrical airflow streamlines over a leading edge of the splitter.

11 Claims, 3 Drawing Sheets

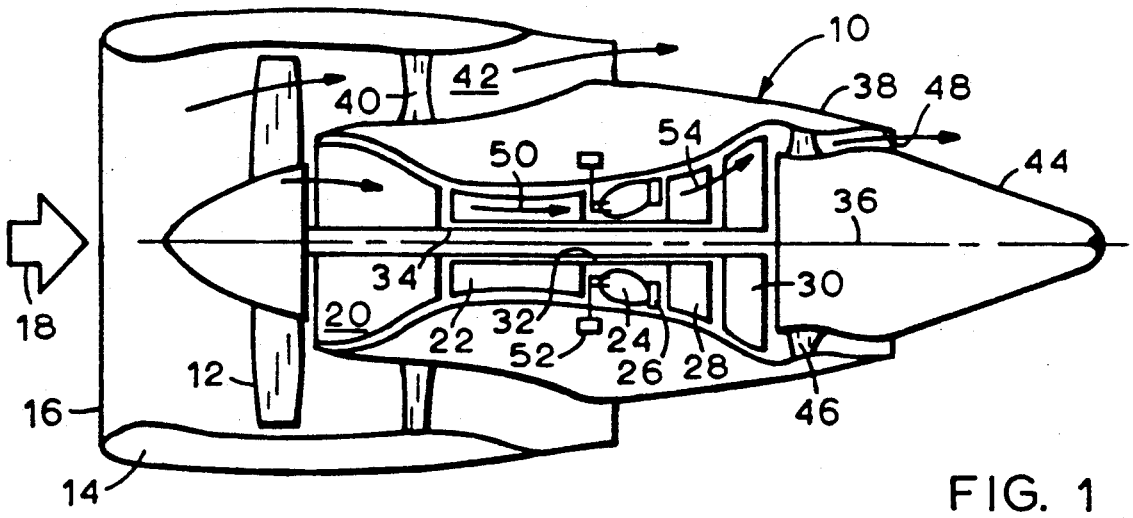
FIG. 1
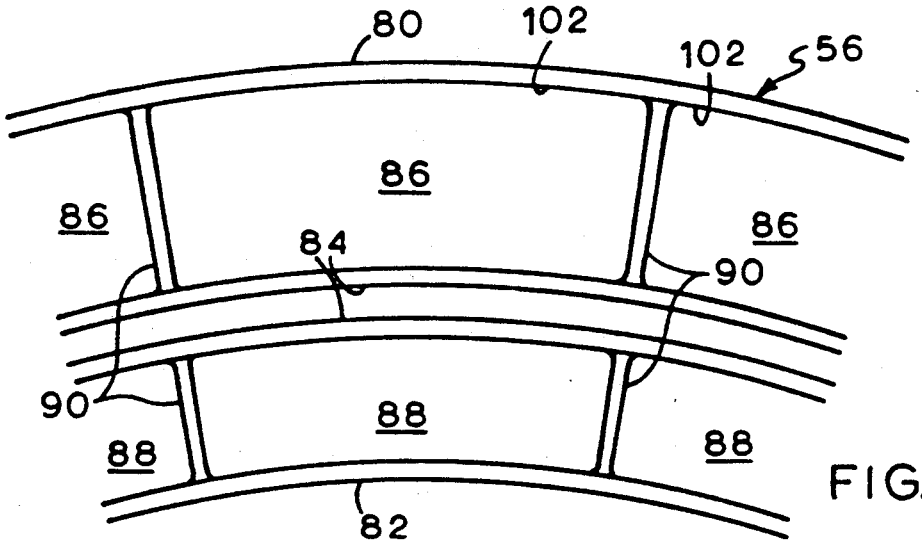
FIG. 3
FIG. 5
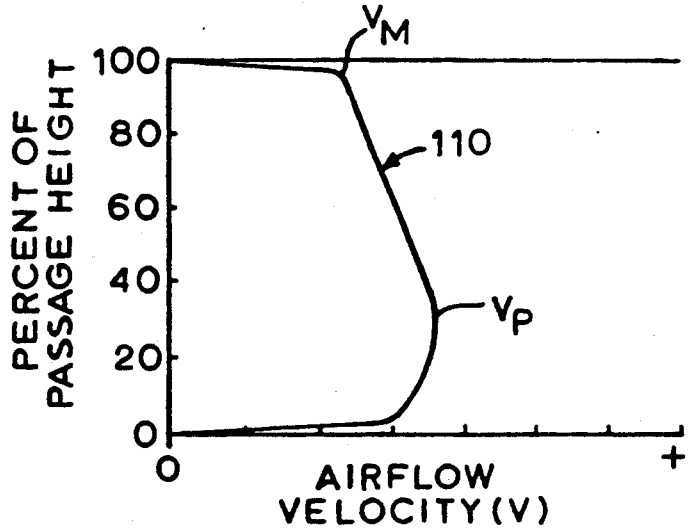

PROFILE MATCHED DIFFUSER

TECHNICAL FIELD

The present invention relates generally to a gas turbine engine compressor and diffuser for diffusing compressed air received therefrom, and, more specifically, to a multiple passage diffuser.

BACKGROUND ART

A gas turbine engine compressor is effective for providing compressed or pressurized airflow to a combustor wherein it is mixed with fuel for undergoing combustion for powering the engine. The compressed airflow is discharged from the compressor at a relatively high velocity and, therefore, a diffuser is typically utilized for decreasing the velocity of the compressed airflow while increasing the static pressure thereof, which is known as pressure recovery, for obtaining more efficient operation of the combustor and engine. A conventional diffuser has an inlet and an outlet defined between diverging walls with an effective area ratio of the outlet area over the inlet area for obtaining diffusion. The diffuser also includes a length from the inlet to the outlet and the inlet has a specific height.

The amount of divergence of the diffuser walls is relatively small with a relatively small corresponding area ratio to ensure that diffusion occurs without undesirable flow separation from the walls which results in conventionally known stall which adversely affects performance of the diffuser. The conventionally known Stanford criteria are used for optimizing the area ratio for particular diffusers as a function of the length to height ratio. For a given length to height ratio, a maximum area ratio is required for preventing flow separation in the diffuser and maintaining an acceptable flow separation, or stall margin.

In order to reduce the length of the diffuser, it is conventionally known in the literature to provide a diffuser having multiple diffusing channels, for example two diffuser channels separated by a circumferentially extending splitter. In a multi-channel diffuser, the compressed airflow from the compressor is divided by the splitter and portions thereof are channeled in parallel through the several channels for separately diffusing the airflow portions. Although each channel is smaller than the original single channel which would otherwise be required, each channel can still have the same length to height ratios and equal area ratios for maximizing pressure recovery with acceptable flow separation margin. The several multi-channels, which are relatively shorter than a corresponding single channel diffuser, can thus collectively provide the same amount of total pressure recovery from the airflow.

However, a multi-channel diffuser is inherently more complex than a single channel diffuser and is similarly subject to pressure losses during operation which decrease efficiency of the diffuser and decrease pressure recovery, and is also subject to flow separation at the four walls defining the two channels.

Furthermore, a diffuser is typically designed for operation of the compressor at a particular design point, or velocity condition of the discharged compressor airflow. During the life of the gas turbine engine and compressor, normal wear of the engine results in changes to the designed-for velocity condition of the discharged compressor airflow, which in turn affects performance of the diffuser including pressure recovery and stall margin.

OBJECTS OF THE INVENTION

Accordingly, one object of the present invention is to provide a new and improved multi-channel diffuser for a gas turbine engine.

Another object of the present invention is to provide a multi-channel diffuser having improved efficiency and pressure recovery.

Another object of the present invention is to provide a multi-channel diffuser having improved flow separation margin.

Another object of the present invention is to provide a diffuser effective for maintaining improved pressure recovery and flow separation margin as compressed airflow velocity conditions change during the life of the compressor.

Another object of the present invention is to provide a multi-channel diffuser having a reduced length.

DISCLOSURE OF INVENTION

A method of diffusing airflow includes diffusing first and second airflow portions at first and second diffusion rates, respectively, which are unequal for improving pressure recovery. An exemplary diffuser for practicing the invention includes first and second channels separated by a splitter for separately diffusing first and second airflow portions, respectively. The first and second channels have first and second area ratios, respectively, which are unequal for obtaining increased pressure recovery. In the preferred embodiment, the first and second area ratios are preselected for obtaining substantially symmetrical airflow streamlines over a leading edge of the splitter.

BRIEF DESCRIPTION OF DRAWINGS

The novel features believed characteristic of the invention are set forth and differentiated in the claims. The invention, in accordance with a preferred and exemplary embodiment, together with further objects and advantages thereof, is more particularly described in the following detailed description taken in conjunction with the accompanying drawing in which:

FIG. 1 is a longitudinal sectional schematic view of a high bypass turbofan gas turbine engine having a diffuser in accordance with the present invention.

FIG. 3 is an upstream facing end view of a portion of the diffuser illustrated in FIG. 2 taken along line 3—3.

FIG. 5 is a graph plotting airflow velocity versus the percent of passage height for compressed airflow channeled to the exemplary diffuser of the present invention.

MODES(S) FOR CARRYING OUT THE INVENTION

Figure 2:
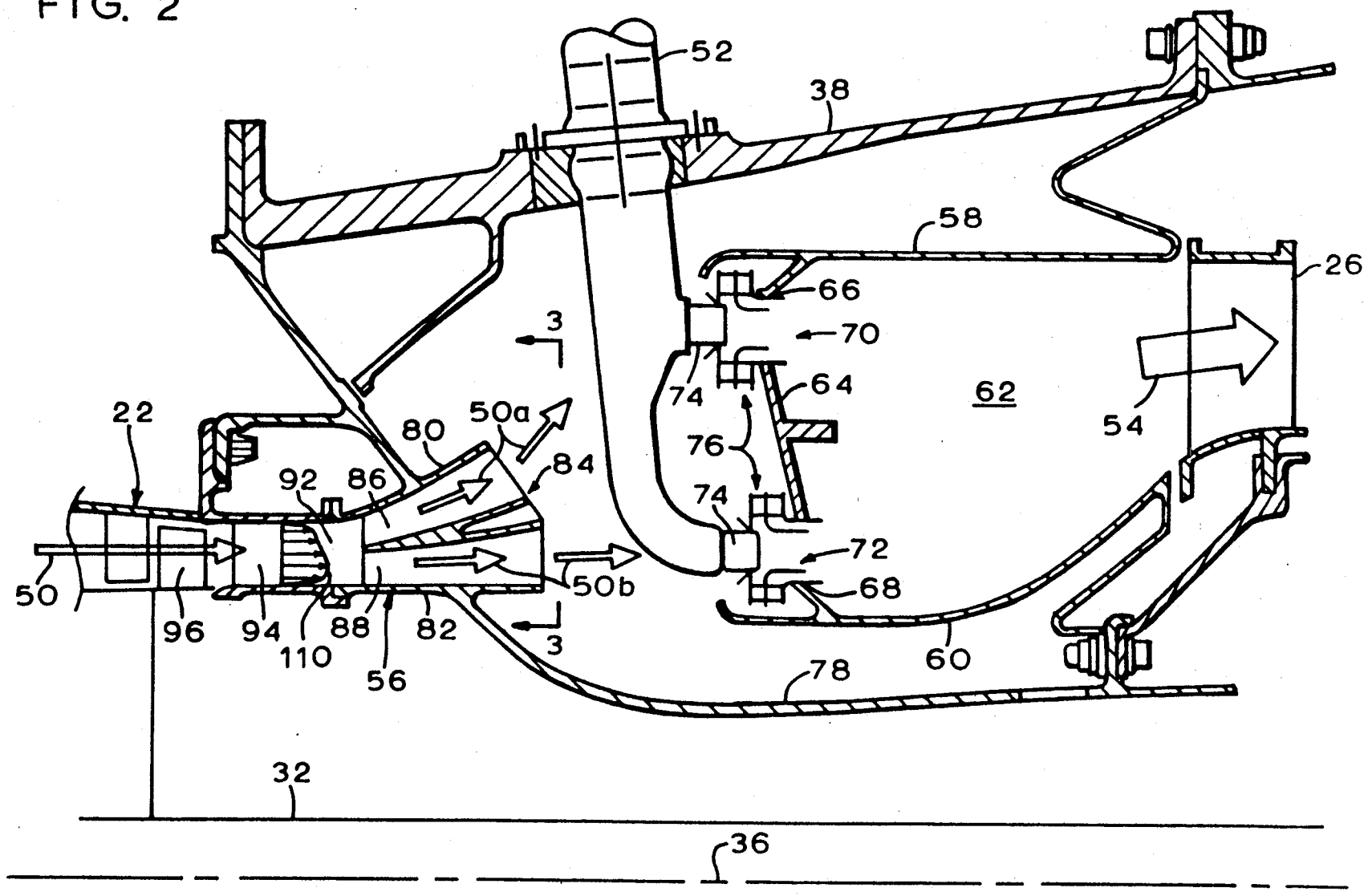
FIG. 2 is a longitudinal sectional view, partly schematic, of the diffuser in accordance with one embodiment of the present invention providing compressed airflow to an exemplary double annular combustor.

Illustrated in FIG. 1 is a longitudinal sectional schematic view of a high bypass turbofan engine 10. The engine 10 includes a conventional fan 12 disposed inside a fan cowl 14 having an inlet 16 for receiving ambient airflow 18. Disposed downstream of the fan 12 is a conventional low pressure compressor (LPC) 20 followed in serial flow communication by a conventional high pressure compressor (HPC) 22, a combustor 24, a conventional high pressure turbine nozzle 26, a conventional high pressure turbine (HPT) 28 and a conventional low pressure turbine (LPT) 30. The HPT 28 is conventionally fixedly connected to the HPC 22 by an HP shaft 32, and the LPT 30 is conventionally connected to the LPC 20 by a conventional LP shaft 34. The LP shaft 34 is also conventionally fixedly connected to the fan 12. The engine 10 is symmetrical about a longitudinal centerline axis 36 disposed coaxially with the HP and LP shafts 32 and 34.

The fan cowl 14 is conventionally fixedly attached to and spaced from an outer casing 38 by a plurality of circumferentially spaced conventional struts 40 defining therebetween a conventional annular fan bypass duct 42. The outer casing 38 surrounds the engine 10 from the LPC 20 to the HPT 30. A conventional exhaust cone 44 is spaced radially inwardly from the casing 38 and downstream of the LPT 30, and is fixedly connected thereto by a plurality of conventional circumferentially spaced frame struts 46 to define an annular core outlet 48 of the engine 10.

During operation, the airflow 18 is compressed in turn by the LPC 20 and HPC 22 and is then provided as pressurized compressed airflow 50 to the combustor 24. Conventional fuel injection means 52 provide fuel to the combustor 24 which is mixed with the compressed airflow 50 and undergoes combustion in the combustor 24 for generating combustion discharge gases 54. The gases 54 flow in turn through the HPT 28 and the LPT 30 wherein energy is extracted for rotating the HP and LP shafts 32 and 34 for driving the HPC 22, and the LPC 20 and fan 12, respectively.

Illustrated in FIG. 2 is a longitudinal sectional view of the combustor 24. Disposed upstream of the combustor 24 is a diffuser 56 in accordance with a preferred and exemplary embodiment of the present invention, which reduces the velocity of the compressed airflow 50 received from the HPC 22 for increasing its pressure and channelling the pressurized airflow 50 to the combustor 24.

The combustor 24 includes annular outer and inner liners 58 and 60, respectively, disposed coaxially about the centerline axis 36. The outer and inner liners 58 and 60 are spaced radially from each other to define an annular combustion zone 62 therebetween in which the compressed airflow 50 and fuel from the fuel injection means 52 undergoes combustion for generating the discharge gases 54.

An annular dome 64 is conventionally fixedly joined to the outer and inner liners. The dome 64 includes a plurality of circumferentially spaced radially outer apertures 66 and a plurality of circumferentially spaced radially inner apertures 68 for receiving two radially spaced rows of circumferentially spaced carburetors 70 and 72. The first and second carburetors 70 and 72 each comprise a conventional fuel injector 74 which provides fuel to a conventional counter-rotational swirler 76 for providing fuel/air mixtures into the combustion zone 62 for combustion.

The outer liner 58 is conventionally fixedly connected to the stationary casing 38, and the inner liner 60 is conventionally fixedly connected to a stationary inner casing 78.

As illustrated if FIGS. 2 and 3, the diffuser 56 in accordance with a preferred and exemplary embodiment of the present invention is an annular diffuser disposed coaxially about the centerline axis 36 and includes an annular, radially outer, first wall 80 and a radially inner, annular second wall 82 spaced radially inwardly from the first wall 80. An annular flow splitter 84 is disposed and spaced coaxially between the first and second walls 80 and 82 to define with the first wall 80 a generally axially extending diffuser first or outer flow channel 86 therebetween for diffusing a first portion 50*a* of the compressed airflow 50 channeled therethrough. The splitter 84 defines with the second wall 82 a generally axially extending diffuser second, or inner flow channel 88 therebetween for diffusing a second portion 50*b* of the compressed airflow 50 channeled therethrough. As shown more particularly in FIG. 3, the splitter 84 is fixedly connected between the outer wall 80 and the inner wall 82 by a plurality of circumferentially spaced, radially extending frame struts 90 formed integrally therewith, by casting for example.

The diffuser 56 also includes an annular inlet passage 92 disposed upstream from the splitter 84 and in flow communication with the outer and inner channels 86 and 88. The passage 92 is also disposed in flow communication with the HPC 22 for receiving the compressed airflow 50 channeled thereto through a plurality of circumferentially spaced conventional outlet guide vanes (OGVs) 94 of the HPC 22. The HPC 22 includes a conventional downstream aft stage having a plurality of circumferentially spaced compressor blades 96 which provide the compressed airflow 50 through the OGVs 94 to the diffuser inlet passage 92.

Figure 4:
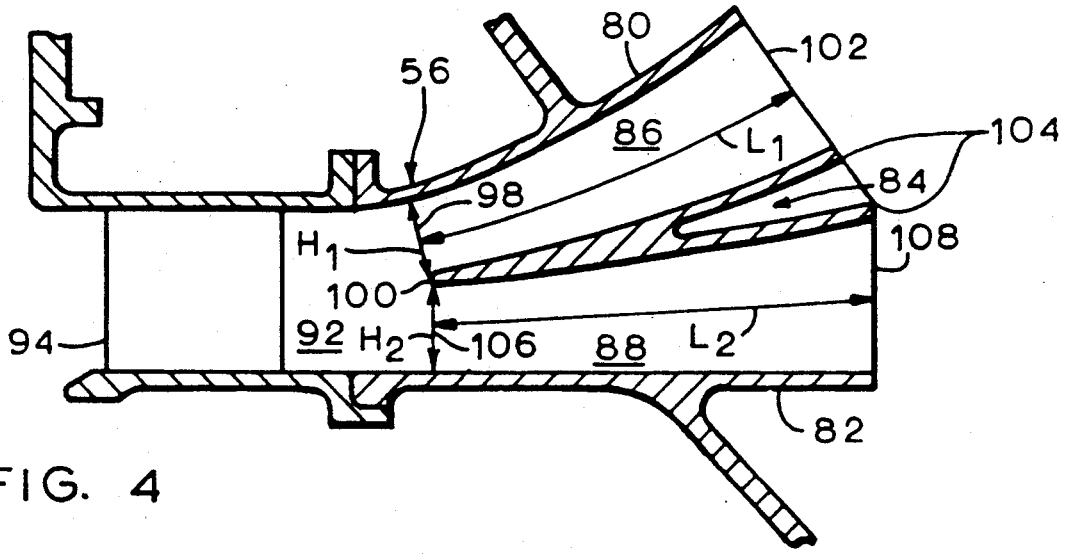
FIG. 4 is an enlarged view of the diffuser illustrated in FIG. 2.

Illustrated in more particularity in FIG. 4 is the diffuser 56. The outer channel 86 includes an outer, or first inlet 98 defined between the outer wall 80 and a leading edge 100 of the splitter 84 for receiving the airflow first portion 50*a*. The outer inlet 98 has a generally radially extending height $H_1$. The outer channel 86 also includes a first, or outer outlet 102 defined between the outer wall 80 and an aft end 104 of the splitter 84. The outer channel 86 has a length $L_1$ defined from the inlet 98 to the outlet 102 along generally a flow centerline extending therebetween. The outer inlet 98 has a first, or outer inlet flow area $A_1^I$ and the outer outlet 102 has a first, or outer outlet flow area $A_1^0$. These inlet and outlet flow areas are the respective collective flow areas around the circumference of the outer channel 86 through which the airflow first portion 50*a* flows.

The outer channel 86 is effective for diffusing the airflow first portion 50*a* by having an increase in flow area through the channel 86 with a larger outer outlet flow area $A_1^0$ over a smaller outer inlet flow area $A_1^I$ defining a first, or outer area ratio $AR_1$ which is predeterminedly greater than one.

Similarly, the inner channel 88 includes a first, or inner inlet 106 defined between the inner wall 82 and the splitter leading edge 100 for receiving the airflow second portion 50*b*. The inner channel 88 also includes a second, or inner outlet 108 defined between the inner wall 82 and the splitter aft end 104. The inner inlet 106 has a generally radially extending height $H_2$ and a second or inner inlet flow area $A_2^I$. The inner outlet 108 has a second, or inner outlet flow area $A_x^0$. The inner channel 88 has a length $L_2$ extending from the inlet 106 to the outlet 108 along generally the flow centerline extending therebetween. The inner outlet flow area $A_2^0$ is greater than the inner inlet flow area $A_2^I$ with a second, or inner area ratio $AR_2$ being greater than one for diffusing the airflow second portion 50*b* channeled therethrough.

As illustrated in FIG. 2, the HPC 22 in this exemplary embodiment of the present invention is an axial flow compressor having the blades 96 which extend in a radially outward direction. Due to conventional effects including centrifugal forces and tip clearances of the blades 96, the compressed airflow 50 is discharged from the HPC 22 through the OGVs 94 with a nonsymmetrical velocity profile 110 which varies radially across the OGVs 94 and radially across the diffuser 56.

More specifically, FIG. 5 is an analytically based graph plotting velocity of the compressed airflow 50 in its abscissa versus percent of passage height in its ordinate, which is a radial velocity distribution or profile 110 across the diffuser inlet passage 92 of the axially flowing airflow 50. The velocity profile 110 has a peak velocity $V_P$ below the middle of the passage height at about 30%, and a minimum velocity $V_M$ at the top of the passage at 100%.

In a conventionally designed multi-channel diffuser, the channels would have equal area ratios in both the outer and inner diffuser channels for obtaining uniform diffusion. The area ratios are conventionally determined based on, for example, conventionally known Stanford criteria for optimizing diffusion and pressure recovery while maintaining acceptable stall margin. Acceptable area ratio is related to the length/height value of the diffuser as is conventionally known.

Figure 6:
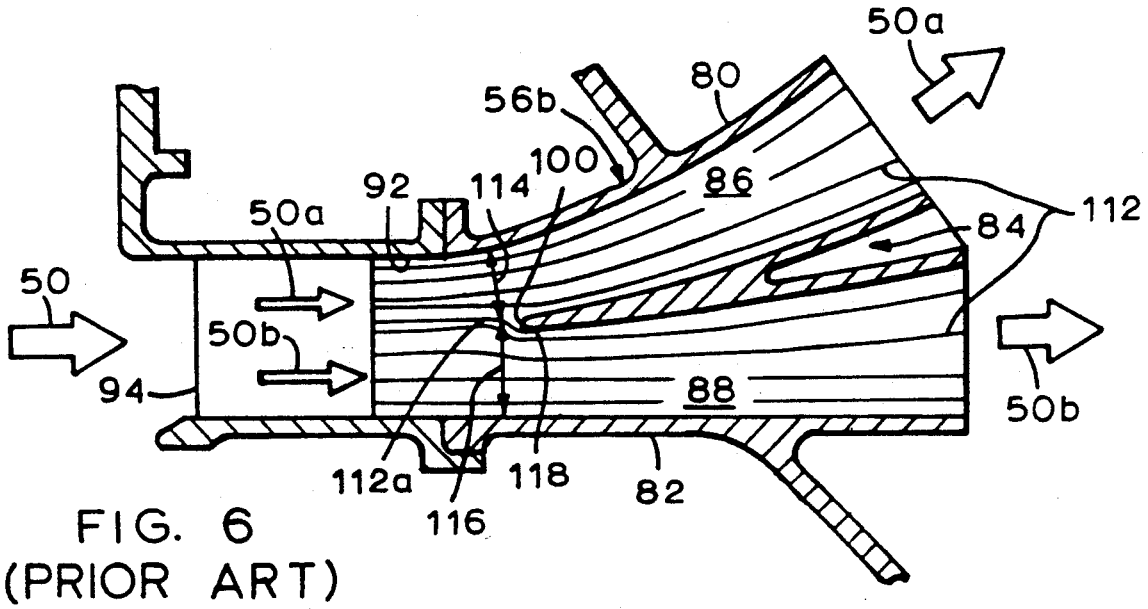
FIG. 6 (PRIOR ART)
FIG. 6 is an embodiment of a diffuser according to the prior art having equal area ratios in the outer and inner diffuser channels and illustrates representative streamlines of the compressed airflow being diffused therein.

FIG. 6 illustrates the diffuser 56, designated 56*b*, conventionally designed for obtaining equal area ratios $AR_1$ and $AR_2$. Illustrated in FIG. 6 are representative flow streamlines 112 determined analytically for the diffuser 56*b* for the nonsymmetrical velocity profile 110 illustrated in FIG. 5. Analysis predicts the formation of undesirable flow curvature of the streamlines 112 upstream of the splitter 84 due to radial pressure gradients at the inlets and outlets of the diffuser 56. Representative of this flow curvature is a generally mid-flow streamline 112*a* which initially flows generally parallel to the outer and inner walls 80 and 82 in the passage 92 but then curves relatively sharply from just upstream of the outer channel 86 away from the outer channel 86, around the splitter leading edge 100 and into the inner channel 88. The streamlines 112 above the midflow streamline 112*a* comprise the airflow first portion 50*a* which flows through the outer channel 86, and includes the relatively low velocity portion of the velocity profile 110 including the minimum velocity $V_M$. The streamlines 112 below and including the mid-flow streamline 112*a* comprise the airflow second portion 50*b* which flows through the inner channel 86, and includes the relatively high velocity portion of the velocity profile 110 including the peak velocity $V_p$.

The flow curvature associated with the mid-flow streamline 112*a* in effect increases the effective area ratio in the outer channel 86 because significant diffusion occurs upstream of the splitter leading edge 100 beginning at an outer inlet annulus designated 114 formed in effect aerodynamically at about the position of streamline curvature at the representative curved streamline 112*a*. A complementary inner inlet annulus 116 extends from the outer annulus 114 to the inner wall 82 wherein the airflow second portion 50*b* captured by the inner channel 88 accelerates into the inner passage 88 beginning upstream of the splitter leading edge 100, which in effect results in a lower effective area ratio for the inner channel 88.

Accordingly, the airflow first portion 50*a* which is captured and channeled through the outer channel 86 begins diffusion prematurely upstream of the splitter leading edge 100, and the airflow second portion 50*b* undergoes undesirable acceleration immediately upstream of the splitter leading edge 100 prior to entering the inner channel 88. This results in decreased pressure recovery of the compressed airflow 50, increased probability of flow separation, and decreased stall margin. For example, analytical pressure contours generated for the diffuser 56*b* illustrated in FIG. 6 predicts locally high diffusion at about the outer inlet annulus 114. And, the relatively large curvature of the streamline 112*a* around the splitter leading edge 100 results in a relatively high angle of attack of the airflow over the leading edge 100 into the inner channel 88 which increases the chance of flow separation immediately downstream of the leading edge 100 at about location 118 illustrated in FIG. 6. Both of these effects are undesirable since they decrease flow separation margin.

In accordance with the present invention, a method of diffusing the compressed airflow 50 is disclosed for reducing or eliminating the unsymmetrical flow curvature as represented by the curved streamline 112*a* for increasing pressure recovery and flow separation margin. The method preferably includes the steps of diffusing the airflow first portion 50*a* in the outer channel 86 at a first rate of diffusion, diffusing the airflow second portion 50*b* in the inner channel 88 at a second rate of diffusion, with the first and second diffusion rates being unequal for effectively matching the velocity profile 110 to control curvature of the streamlines 112 through the inlets 98 and 106 over the splitter leading edge 100.

In an embodiment wherein the airflow second portion 50*b* includes the peak velocity $V_p$, and the airflow second portion 50*b* is channeled into the inner channel 88, the first diffusion rate of the compressed airflow first portion 50*a* through the outer channel 86 is predeterminedly greater than the second diffusion rate of the compressed airflow second portion 50*b* channeled through the inner channel 88. The difference in the first and second diffusion rates may be conventionally determined for particular design applications for reducing the streamline curvature as indicated, for example, by the streamline 112*a* of FIG. 6.

In the preferred embodiment of the invention, the preferred first and second diffusion rates are obtained by sizing the diffuser 56 for obtaining unequal first and second area ratios $AR_1$ and $AR_2$, with the first area ratio $AR_1$ being predeterminedly greater than the second area ratio $AR_2$. The first and second area ratios may be conventionally obtained for particular design applications for obtaining the preferred rates of diffusion described above.

Figure 7:
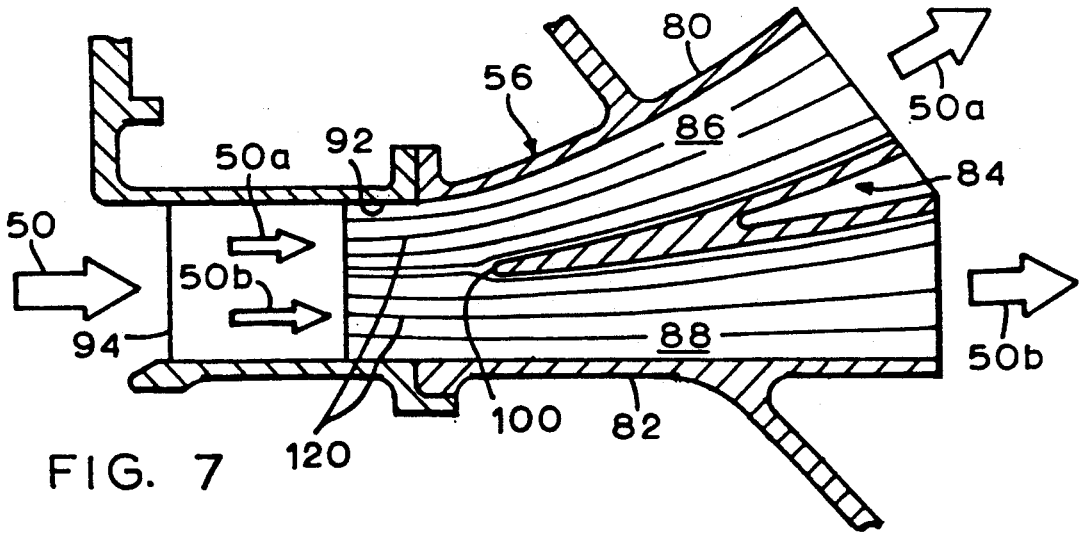
FIG. 7 is an embodiment of the diffuser illustrated in FIG. 4 having unequal area ratios of the outer and inner diffuser channels and illustrates substantially symmetrical streamlines of the compressed airflow being diffused therein.

Illustrated in FIG. 7 is the diffuser 56 sized for having the first area ratio $AR_1$ of the outer channel 86 greater than the second area ratio $AR_2$ of the inner channel 88 for obtaining a higher rate of diffusion in the outer channel 86 as compared to the inner channel 88. The first and second area ratios may be predeterminedly selected for particular design applications for obtaining substantially symmetrical streamlines 120 of the compressed airflow 50 over the splitter leading edge 100 as shown. By providing different, or substantially unequal area ratios in the outer channel 86 and the inner channel 88, the amount of diffusion occurring therein can be matched to the velocity profile, such as the profile 110 provided by the HPC 22 to the diffuser 56. Since the peak velocity $V_P$ occurs along the radially inner portion of the OGVs 94 and the passage 92, the radially inner diffuser channel 88 is predeterminedly sized for having a decreased area ratio and rate of diffusion for reducing, and in the optimum situation eliminating the unsymmetrical flow curvature of the streamlines around the splitter leading edge 100.

More specifically, the streamlines 120 illustrated in FIG. 7 are symmetrical over the leading edge 100 without the nonsymmetrical or off-set curvature associated with the curved streamline 112*a* illustrated in FIG. 6. Thusly, the outer inlet annulus 114 having premature diffusion is effectively eliminated, and the inner inlet annulus 116 having flow acceleration is also effectively eliminated.

Accordingly, lower pressure losses will be generated in the diffuser 56 with a corresponding increase in pressure recovery of the compressed airflow 50, with improved flow separation margin. In an optimum design, each of the inner and outer channels 86 and 88 may be conventionally designed based on conventional criteria such as the Stanford criteria for providing maximum pressure recovery as a function of length to height ratio of the separate diffuser channels and for obtaining preferred flow separation margins. Referring again to FIG. 2, the exemplary embodiment of the diffuser 56 illustrated includes the two, outer and inner diffuser channels 86 and 88 designed for providing the compressed airflow first portion 50*a* generally to the outer carburetor 70, and the compressed airflow second portion 50*b* to the inner carburetors 72 of the combustor 24. In one embodiment, the outer channel 86 is sized for receiving and channeling the airflow first portion 50*a*, at a first mass or weight flow rate $W_1$, and the inner channel 88 is predeterminedly sized for receiving and channeling the compressed airflow second portion 50*b* at a second mass, or weight flow rate $W_2$. The first and second flow rates $W_1$ and $W_2$ and the first and second area ratios $AR_1$ and $AR_2$ are preselected so that both the outer and inner channels 86 and 88 effect substantially equal first and second flow separation margins, respectively. The conventionally known Stanford criteria are used for selecting the area ratios in the outer and inner channels 86 and 88 based on the $L_1/H_1$ and $L_2/H_2$ ratios for maximizing pressure recovery in each of the diffuser channels 86 and 88 while obtaining acceptable flow separation margin.

In one embodiment, the inner channel 88 can be sized for obtaining a second flow rate $W_2$ which is unequal to the first flow rate $W_1$ of the outer channel 86, and for example may be greater than the first flow rate $W_1$ for providing more airflow to the radially inner carburetor 72 for obtaining more output power from the radially inner portion of the combustor 24. In alternate embodiments, the outer and inner channels 86 and 88 may be sized so that the flow rates $W_1$ and $W_2$ are equal.

In either situation, the respective area ratios of the outer and inner diffuser channels 86 and 88 may be predeterminedly selected in accordance with the present invention for matching the velocity profile of the compressed airflow 50 provided to the diffuser 56 for each engine application. The area ratios of the outer and inner channels 86 and 88 may be obtained conventionally by varying, for example, the respective areas of the inlets 98 and 106 and the outlets 102 and 108. In the preferred embodiment, the diffuser channel which receives the compressed airflow portion including the peak velocity $V_P$ is designed for obtaining a smaller area ratio than the area ratio of the other diffuser channel. Alternatively, the diffuser channel receiving the lower velocity regions of the velocity profile 110 is designed for having a larger area ratio than that of the other diffuser channel(s).

Since the velocity profile 110 may vary during operation and throughout the useful life of the engine 10, the improved diffuser 56 in accordance with the present invention is effective for providing improved tolerance to such variation by reducing pressure losses for obtaining improved pressure recovery since the diffuser 56 can be designed to match the expected velocity profile. For example, a conventionally designed equal area ratio multichannel diffuser which is not matched to the compressed airflow velocity profile will necessarily result in undesirable pressure losses which will increase depending upon the degree of variability of the velocity profile which occurs during operation and over the useful life of the engine. By initially designing a multi-channel diffuser in accordance with the present invention for matching the expected velocity profile of the compressed airflow, the pressure losses are reduced, thusly increasing pressure recovery and therefore providing an improved diffuser both initially and over the useful life of the engine.

Furthermore, the multi-channel diffuser in accordance with the present invention can be sized to preferentially control the streamlines 120 to introduce an initial curvature, for example, opposite to that shown in FIG. 6 to offset expected changes in the velocity profile 110 over engine life. In this way, average performance of the diffuser 56 may be improved over life.

While there has been described herein what is considered to be a preferred embodiment of the present invention, other modifications of the invention shall be apparent to those skilled in the art from the teachings herein, and it is, therefore, desired to be secured in the appended claims all such modifications as fall within the true spirit and scope of the invention.

More specifically, and for example only, although a two-channel diffuser has been described, other multichannel diffusers having more than two channels may also be utilized with varying rates of diffusion and area ratio in the respective channels thereof in accordance with the present invention. By matching the rates of diffusion of the various diffuser channels with the expected velocity profiles of the compressed airflow channeled to the diffuser, improved pressure recovery may be obtained with improved flow separation margin. Furthermore, although the improved method and diffuser have been described with respect to an axial compressor and double annular combustor, it may also be used for other types of compressors and combustors.

Accordingly, what is desired to be secured by Letters Patent of the United States is the invention as defined and differentiated in the following claims:

1. In a gas turbine engine diffuser for diffusing compressed airflow received from a compressor, said compressor having a diffuser first channel and a diffuser second channel disposed in parallel flow communication relative to a flow splitter having a leading edge, a method of diffusing said airflow comprising:

diffusing a first portion of said airflow in said first channel at a first rate of diffusion;

diffusing a second portion of said airflow in said second channel at a second rate of diffusion; and said first and second diffusion rates being unequal.

2. A method of diffusing airflow according to claim 1 further including providing said diffuser with said airflow having a nonsymmetrical velocity profile across said diffuser, said velocity profile including a peak velocity in said airflow second portion, and channeling said airflow second portion into said second channel, and said first diffusion rate being greater than said second diffusion rate.

3. A method of diffusing airflow according to claim 2 wherein said first and second channels have first and second area ratios, respectively, and said first area ratio is greater than said second area ratio.

4. A method of diffusing airflow according to claim 3 further including diffusing said first and second airflow portions at said first and second diffusion rates for obtaining substantially symmetrical streamlines of said airflow over said splitter leading edge.

5. A method of diffusing airflow according to claim 1 further including diffusing said first and second airflow portions at said first and second diffusion rates for obtaining substantially symmetrical streamlines of said airflow over said splitter leading edge.

6. A diffuser for a gas turbine engine having a compressor providing compressed airflow comprising:

a first wall;

a second wall spaced from said first wall;

a flow splitter having a leading edge and an aft end and disposed between said first and second walls to define with said first wall a first channel therebetween for diffusing a first portion of said airflow channeled therethrough, and to define with said second wall a second channel therebetween for diffusing a second portion of said airflow channeled therethrough;

said first channel having a first inlet defined between said first wall and said splitter leading edge for receiving said airflow first portion, and a first outlet defined between said first wall and said splitter aft end, said first inlet having a first inlet flow area and said first outlet having a first outlet flow area, said first outlet flow area over said first inlet flow area defining a first area ratio for diffusing said airflow first portion in said channel;

said second channel having a second inlet defined between said second wall and said splitter leading edge for receiving said second airflow portion, and a second outlet defined between said second wall and said splitter aft end, said second inlet having a second inlet flow area and said second outlet having a second outlet flow area, said second outlet flow area over said second inlet flow area defining a second area ratio for diffusing said airflow second portion in said second channel; and said first and second area ratios being unequal.

7. A diffuser according to claim 6 wherein said compressor is effective for providing said airflow with a nonsymmetrical velocity profile including a peak velocity in said airflow second portion, said second channel is alignable with said compressor for receiving said airflow second portion, and said first area ratio is greater than said second area ratio.

8. A diffuser according to claim 7 wherein said compressor is an axial flow compressor and said first channel is disposed radially outwardly of said second channel.

9. A diffuser according to claim 7 wherein said first channel is sized for receiving said airflow first portion at a first flow rate, said second channel is sized for receiving said airflow second portion at a second flow rate, and said first and second flow rates and said first and second area ratios are preselected so that both said first and second channels effect substantially equal first and second flow separation margins, respectively.

10. A diffuser according to claim 9 wherein said first and second flow rates are unequal.

11. A diffuser according to claim 9 wherein said first and second flow rates are equal.

* * * * *